US007527087B2

(12) United States Patent
Desai et al.

(10) Patent No.: US 7,527,087 B2
(45) **Date of Patent: *May 5, 2009**

(54) HEAT EXCHANGER

(75) Inventors: Sameer Desai, Lake Orion, MI (US); Lei Fang, W. Lafayette, IN (US); Jason McKittrick, Holton, IN (US)

(73) Assignee: Valeo, Inc., Auburn Hills, MI (US)

( * ) Notice: Subject to any disclaimer, the term of this patent is extended or adjusted under 35 U.S.C. 154(b) by 25 days.

This patent is subject to a terminal disclaimer.

(21) Appl. No.: 10/608,422

(22) Filed: Jun. 30, 2003

(65) Prior Publication Data

US 2005/0006068 A1 Jan. 13, 2005

(51) Int. Cl.
*F28D 7/10* (2006.01)

(52) U.S. Cl. ..... 165/140; 165/148; 165/174; 165/176

(58) Field of Classification Search ..... 165/140, 165/174, 176, 148; 62/515
See application file for complete search history.

(56) References Cited

U.S. PATENT DOCUMENTS

| | | | | |
|---|---|---|---|---|
| 4,923,001 | A * | 5/1990 | Marcolin | 165/140 |
| 5,036,911 | A | 8/1991 | So et al. | |
| 5,575,329 | A | 11/1996 | So et al. | |
| 6,082,447 | A | 7/2000 | Insalaco et al. | |
| 6,119,340 | A | 9/2000 | Insalaco et al. | |
| 6,158,500 | A | 12/2000 | Heine | |
| 6,173,766 | B1 * | 1/2001 | Nakamura et al. | 165/140 |
| 6,394,176 | B1 | 5/2002 | Marsais | |
| 6,793,012 | B2 * | 9/2004 | Fang et al. | 165/140 |
| 6,904,963 | B2 * | 6/2005 | Hu | 165/140 |
| 2002/0040776 | A1 * | 4/2002 | Kokubunji et al. | 165/140 |

FOREIGN PATENT DOCUMENTS

| | | | | |
|---|---|---|---|---|
| EP | 0 789 213 | A2 | 8/1997 | |
| EP | 0 789 213 | A3 | 8/1997 | |
| EP | 1 003 005 | A1 | 5/2000 | |
| JP | 59-205591 | * | 11/1984 | 165/174 |
| JP | 63-197887 | * | 8/1988 | 165/174 |
| JP | 3-79085 | | 8/1991 | |
| JP | 4-369396 | | 12/1992 | |
| JP | 7-17964 | | 4/1995 | |
| JP | 2001-174168 | | 6/2001 | |

* cited by examiner

*Primary Examiner*—Ljiljana (Lil) V Ciric
(74) *Attorney, Agent, or Firm*—Dierker & Associates, P.C.

(57) ABSTRACT

An improved heat exchanger for an automotive vehicle, comprising at least one end tank; and at least two heat exchangers including a plurality of spaced apart metal tubes with fins between the spaced tubes. The heat exchangers are preferentially disposed so that their respective tubes and fins are generally co-planar with each other and are connected to the end tank. In preferred embodiments, the heat exchanger may include a radiator element.

25 Claims, 7 Drawing Sheets

HEAT EXCHANGER

FIELD OF THE INVENTION

BACKGROUND OF THE INVENTION

It has become increasingly desirable for heat exchangers to exhibit efficient transfer of heat, while remaining relatively easy to make. In the automotive industry, in particular, it has become increasingly necessary to combine multiple functions in a single heat exchanger assembly. In particular, the need to reduce the number of overall components, and to optimize assembly efficiency has driven the need for improved heat exchanger devices that combine increasingly efficient designs and multiple functions in packaging heretofore attainable using plural separate components or devices having inefficient designs. More specifically, there has been a growing need for an improved heat exchanger device, particularly for under the hood automotive vehicle applications, which combines multiple functions, that is efficient to make and operate and that occupies substantially the same or less space than existing heat exchanger devices.

Particularly in extreme operating conditions and where a multi-fluid heat exchanger is to be employed, it is also attractive to be able to selectively manage heat exchange between the different fluids, especially when the different fluids passed through the heat exchanger have substantially different flow characteristics.

In the automotive industry, there has existed for some time, the need to provide multiple advantages at reduced service and other operating costs. There has also been a need for heater exchange configurations and systems where by not only cross-flow but also down flow configurations are both possible and feasible. Additionally, although so called combo coolers present advantages such as condenser to oil combinations to handle individual heat exchanges in a combined form, it may not meet certain vehicle needs. In automotive applications, fluids such as automotive fluids (oils, coolants, refrigerants, fuels, wind shield wiper fluids, brake fluids, air, CO2, exhaust gasses and the like) are often used. Placing additional fluids on a heat exchanger, preferably in a coplanar arrangement, fluids such as radiator coolant, transmission oil and power steering oil, and the like, surprisingly provides efficiencies and packaging advantages, as well as yielding combination cooler plus additional heat exchanger ('tri-cooler')(three fluid) or dual or multiple combination cooler (combo cooler plus additional fluid) features, which were unavailable even with combo cooler technologies. The present invention meets the above needs by providing an improved heat exchanger without the same packaging limitations as the condenser and oil cooler combinations by providing radiator packaging advantages; with fewer oil cooler line routing limitations; by providing reduced service costs for condenser-oil coolers, by allowing use of combination cooler type technology for non-air conditioned cars; and where down-flow configuration needs to be used.

SUMMARY OF THE INVENTION

The present invention meets the above needs by providing a heat exchanger comprising a first end tank; a second end tank opposite the first end tank; a plurality of first tubes in fluid communication with the first and second end tanks, the plurality of first tubes adapted to have a first fluid flow therethrough; a plurality of second tubes in fluid communication with the first and second end tanks, the plurality of second tubes adapted to have a second fluid, different from the first fluid, flow therethrough; a plurality of fins disposed between the first and second tubes, with the first and second tubes and the fins being generally co-planar relative to each other; wherein at least one of the first fluid or second fluid is a radiator coolant.

In another aspect the present invention is directed to a heat exchanger comprising a first end tank; a second end tank opposite the first end tank; a plurality of first tubes in fluid communication with the first and second end tanks, the plurality of first tubes adapted to have a first fluid flow therethrough; a plurality of second tubes in fluid communication with the first and second end tanks, the plurality of second tubes adapted to have a second fluid, different from the first fluid, flow therethrough; a plurality of third tubes in fluid communication with the the first and second end tanks, the plurality of third tubes adapted to have a third fluid, different from the first or second fluid, flow therethrough; a plurality of fins disposed between the first, second and third tubes, preferably with the majority of the tubes and the fins being generally co-planar relative to each other; wherein at least one of the first fluid, second fluid or third fluid is a radiator fluid.

In another preferred aspect of the present invention, the heat exchanger comprises a first end tank; a second end tank opposite the first end tank; a plurality of first metal tubes in fluid communication with the first and second end tanks, and being adapted to have a first fluid flow there-through; a plurality of second metal tubes in fluid communication with the first and second end tanks, and being adapted to have a second fluid, different from the first fluid, flow there-through; a plurality of third metal tubes in fluid communication with the first and second end tanks, and being adapted to have a third fluid, different from the first fluid or second fluid, flow therethrough and a plurality of fins disposed between any of the first, second or third tubes, with at least two of the first, second or third tubes and the fins being generally co-planar relative to each other; wherein at least one of the first, second or third metal tubes includes an interior wall structure including a partition adapted for subdividing the tube into a plurality of passageways within the tube.

In one particularly preferred embodiment, the present invention contemplates a heat exchanger for an automotive vehicle, comprising at least one end tank; and at least two heat exchangers including a plurality of spaced apart tubes with fins between the spaced tubes; the heat exchangers being disposed so that their respective tubes and fins are generally co-planar with each other and are connected to the end tank; wherein the heat exchangers are selected from the group consisting of an oil heat exchanger, a condenser, a radiator or combinations thereof. Particularly preferred are embodiments where at least one heat exchanger being a radiator, and the other heat exchanger or exchangers being selected from the group consisting of a transmission oil heat exchanger, a power steering oil heat exchanger, a condenser or combinations thereof.

In yet another preferred embodiment, the invention is directed to a heat exchanger for an automotive vehicle, comprising: at least one end tank; at least two heat exchangers including a plurality of spaced apart metal tubes with fins between the spaced tubes; the heat exchangers being disposed so that their respective tubes and fins are generally co-planar with each other and are connected to the end tank; the heat exchangers being selected from the group consisting of an oil heat exchanger, a condenser, a radiator or combinations thereof.

In a further preferred embodiment the heat exchangers may comprise part of a heat exchanger system comprising combination (combo) cooler or tri-cooler heater exchangers with other single (mono), combo or tri-cooler heat exchangers.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENT

Figure 1:
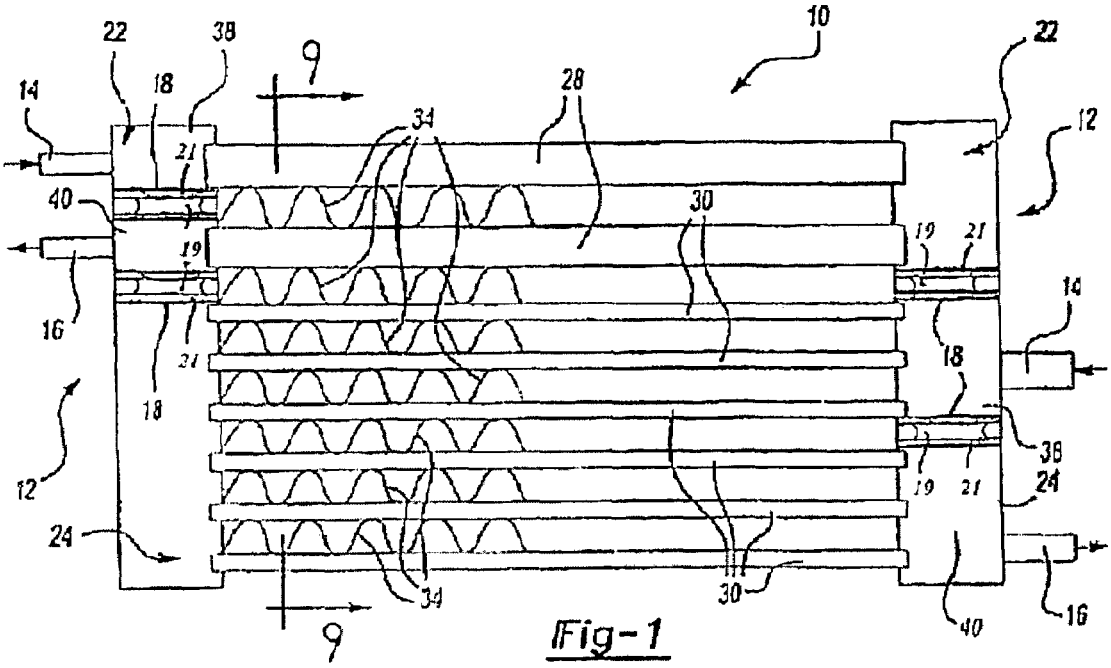
FIG. 1 is an elevational view of an exemplary heat exchanger in accordance with an aspect of the present invention.

Generally, the present invention relates to a heat exchanger and a heat exchanger system employing more than one heat exchanger. The heat exchanger may be a single fluid or multi-fluid (e.g., 2, 3 or 4 fluid) heat exchanger. The heat exchanger may also be a single pass or multi-pass heat exchanger. Although the heat exchanger according to the present invention may be used for a variety of articles of manufacture (e.g., air conditioners, refrigerators or the like), the heat exchanger has been found particularly advantageous for use in automotive vehicles. For example, the heat exchanger may be used for heat transfer of one or more automotive fluids. For example, the heat exchanger may be preferentially used for heat transfer of one or more fluids within a vehicle such as air, oil, transmission oil, power steering oil, radiator fluid, refrigerant, combinations thereof or the like. For example, in a highly preferred embodiments of the present invention there is contemplated a multi-fluid heat exchanger that includes a radiator in combination with a condenser; a, radiator in combination with an oil cooler selected from the group consisting of a power steering oil cooler, a transmission oil cooler and a combination thereof or a radiator in combination with a condenser and an oil cooler selected from the group consisting of a power steering oil cooler, a transmission oil cooler and a combination thereof.

According to one preferred aspect of the invention, the heat exchanger provides an improved multi-fluid heat exchanger having features permitting for ease of assembly of the heat exchanger. According to another preferred aspect, the heat exchanger is optimized for performance by careful selection of such design criteria as hydraulic diameter, tube configuration or a combination thereof.

The heat exchanger may be installed in a variety of locations relative the article of manufacture to which the heat exchanger is applied. For an automotive vehicle, the heat exchanger is preferably located under a hood of the vehicle. According to one highly preferred embodiment, the heat exchanger may be attached to a radiator of the vehicle. Exemplary methods and assemblies for attaching a heat exchanger to a radiator are disclosed in U.S. Pat. No. 6,158,500 and co-pending U.S. provisional patent application Ser. No. 60/355,903, titled "A Method and Assembly for Attaching Heat Exchangers", filed on Feb. 11, 2002 both of which are fully incorporated herein by reference for all purposes.

According to one aspect of the invention, the heat exchanger will comprise a plurality of components that are assembled together by suitable joining techniques. Many techniques may be utilized, including mechanical assemblies and the like. In one preferred embodiment, one or more of the components of the heat exchanger such as the baffles, the end tanks, the tubes, fins, the inlets, the outlets, a bypass or combinations thereof may be attached to each other using brazing Although various brazing techniques may be used, one preferred technique is referred to as controlled atmosphere brazing. Controlled atmosphere brazing typically employs a brazing alloy for attaching components wherein the components are formed of materials with higher melting points than the brazing alloy. The brazing alloy is preferably positioned between components or surfaces of components to be joined and, subsequently, the brazing alloy is heated and melted (e.g., in an oven or furnace, and preferably under a controlled atmosphere). Upon cooling, the brazing alloy preferably forms a metallurgical bond with the components for attaching the components to each other. According to one highly preferred embodiment, the brazing alloy may be provided as a cladding on one of the components of the heat exchanger. In such a situation, it is contemplated that the components may be formed of a material such as a higher melting point aluminum alloy while the cladding may be formed of a lower melting point aluminum alloy.

Heat exchangers of the present invention will typically include one or more tubes, one or more end tanks, one or more inlets and outlets, one or more baffles, one or more fins or a combination thereof. Depending upon the embodiment of the heat exchanger, various different shapes and configurations are contemplated for the components of the heat exchanger. For example, and without limitation, the components may be integral with each other or they may be separate. The shapes and sizes of the components may be varied as needed or desired for various embodiments of the heat exchanger. Additional variations will become apparent upon reading of the following description.

In general, a preferred heat exchanger contemplates at least two spaced apart end tanks bridged together in at least partial fluid communication by a plurality of generally parallel tubes, with fins disposed between the tubes. Optional end plates, or more preferably, end tubes enclose the assembly in a generally co-planar configuration.

More specifically, referring to FIG. 1, there is illustrated a heat exchanger 10 according to one preferred aspect of the present invention. The heat exchanger 10 includes a pair of end tanks 12. Each of the end tanks includes or supports an inlet 14, an outlet 16 and baffles 18. Of course, it is also possible to locate all inlets, outlets and baffles in only one of the end tanks. Additionally, each of the end tanks 12 includes a first tank portion 22 separated from a second portion 24 by at least one of the baffles 18. The heat exchanger 10 also includes a plurality of tubes 28, 30 extending between the end tanks 12. Preferably, the tubes 28, 30 are separated from each other by fins 34.

Depending upon the configuration of the heat exchanger, it may be possible to provide common end tanks that are divided to accommodate more than one fluid or separate end tanks for accommodating plural fluids. It is also possible that end plates can be employed to bridge the end tanks in accordance with the present invention. However, it is particularly preferred that the heat exchanger employs end tubes in lieu of end plates. In this manner, weight savings and improved efficiency is possible owing to a reduced variety of component types.

As mentioned, one advantageous feature of the present invention is the ability to integrate a plurality of different fluid heat exchangers. Though the specification will make apparent that alternatives are possible (e.g. side by side) one particularly preferred approach is to effectively stack a first fluid heat exchanger upon at least a second fluid heat exchanger in a single generally co-planar assembly. In another particularly preferred approach a first fluid heat exchanger is stacked upon at least a second fluid heat exchanger and a third fluid heat exchanger. More preferred is that the at least first, second and third heat exchangers are in a single generally co-planer assembly. Also more preferred is a stacked at least first, second and third heat exchangers in a crossflow or horizontal assembly.

Another advantageous feature of the present invention is the ability to present the integration of the plurality of different fluid heat exchangers as a heat exchanger system. Particularly preferred is a heat exchanger system wherein one heat exchanger is adapted to have a fluid selected from the group of radiator coolant and an automotive fluid and the other heat exchanger is adapted to have a fluid selected from the group of automotive fluids. Another particularly preferred embodiment is a heat exchanger system wherein the heat exchangers are arranged essentially in parallel. Another particularly preferred embodiment is a heat exchanger system wherein the heat exchangers are arranged side by side.

In particularly preferred embodiments of the heat exchanger of the present invention, both cross flow or horizontal and down flow fluid direction may occur. Even more particularly preferred embodiments of heat exchangers of the present invention are those wherein the fluid flow direction is vertical or 'down flow' from top to bottom or bottom to top.

In the preferred embodiment shown, the heat exchanger 10 includes a plurality of a first set of tubes 28 extending between and in fluid communication with a first portion 22 (e.g. an upper portion) of the end tanks 12 and a plurality of a second set of tubes 30 in fluid communication with the second portion 24 (e.g. a lower portion) of the end tanks 12. Moreover, the first portion 22 of one of the end tanks 12 and the second portion 24 of the other of the end tanks 12 are separated into an inlet portion 38 in fluid communication with one of the inlets 14 of the heat exchanger 10 and an outlet portion 40 in fluid communication with one of the outlets 16 of the heat exchanger 10.

The heat exchanger 10 is formed by attaching the tubes 28, 30 to the end tanks 22 either sequentially or simultaneously with one or more fins 34 between each of the opposing tubes 28, 30. The tubes 28, 30 may be attached to the end tanks with fasteners (mating or otherwise), by welding, brazing or the like. Additionally, the fins 34 may be attached or fastened to the tubes 28, 30, the end tanks 22 or both.

In operation, a first fluid enters through the inlet 14 of the inlet portion 38 of a first of the end tanks 12 and flows through passageways 50 of one or more of the first set of tubes 28 to a first portion of a second of the end tanks 12. Thereafter, the first fluid flows through another passageway 50 of one or more of the first set of tubes 28 to the outlet portion 40 and through the outlet 16. Additionally, a second fluid enters the heat exchanger through the inlet 14 of the inlet portion 38 of the second portion 24 of the second of the end tanks 12 and flows through passageways 50 of the second set of tubes 28. The second fluid flows through the outlet 16 of the second portion 24 of the second of the end tanks 12. Of course, as discussed previously, the functions of both of the end tanks can be integrated into a single end tank.

During flow of the first and second fluids through the tubes 28, 30, an ambient fluid preferably flows by over outside of the tubes 28, 30, the fins 34 or both. In turn, heat may be transferred from the first and second fluids to the ambient fluid or from the ambient fluid to the first and second fluids. The first and second fluids may be of the same or a different viscosity. For example, in one preferred embodiment, the first fluid has a higher viscosity than the second fluid. For example, and without limitation, the first fluid may be transmission oil, coolant oil, engine oil, power steering oil or the like while the second fluid will typically be a refrigerant.

Advantageously, if and when different sized tubes are employed, the larger passageways 50 of the first set of tubes 28 are suitable for the flow of more viscous fluids without relatively large pressure drops across the tubes 28 while the smaller passageways 50 of the lower tubes are suitable for lower viscosity fluids. It is also possible to switch the positioning of the tubes so that the first fluid is passed through the second portion or vice versa.

From the above, it will thus be appreciated that one preferred method of the present invention contemplates providing a multi-fluid heat exchanger assembled in a common assembly; passing a first fluid through one portion of the heat exchanger for heat exchange, and passing at least one additional fluid through at least one additional portion of the heat exchanger for heat exchange of the additional fluid.

It is contemplated that a heat exchanger formed in accordance with the present invention may include one or more tubes having various different internal configurations for defining passageways within the tubes. They may also have different external configurations defining one or more outer peripheral surfaces of the tubes. Further it is possible that the internal configurations, external configuration or both vary along the length of the tube.

The internal configuration of a tube may be the same or different from the external configuration. For instance, the walls of the tubes may have opposing sides that are generally parallel to or otherwise complement each other. Alternatively, they may have a different structure relative to each other. The external configuration of the tube may include grooves, ridges, bosses, or other structure along some or all of its length for assisting in heat transfer. Likewise, the internal configuration may include grooves, ridges, bosses or other structure.

It is also possible that the structure is provided for generating turbulence within the fluid, or for otherwise controlling the nature of the flow of fluid there-through or for strength.

Figure 9:
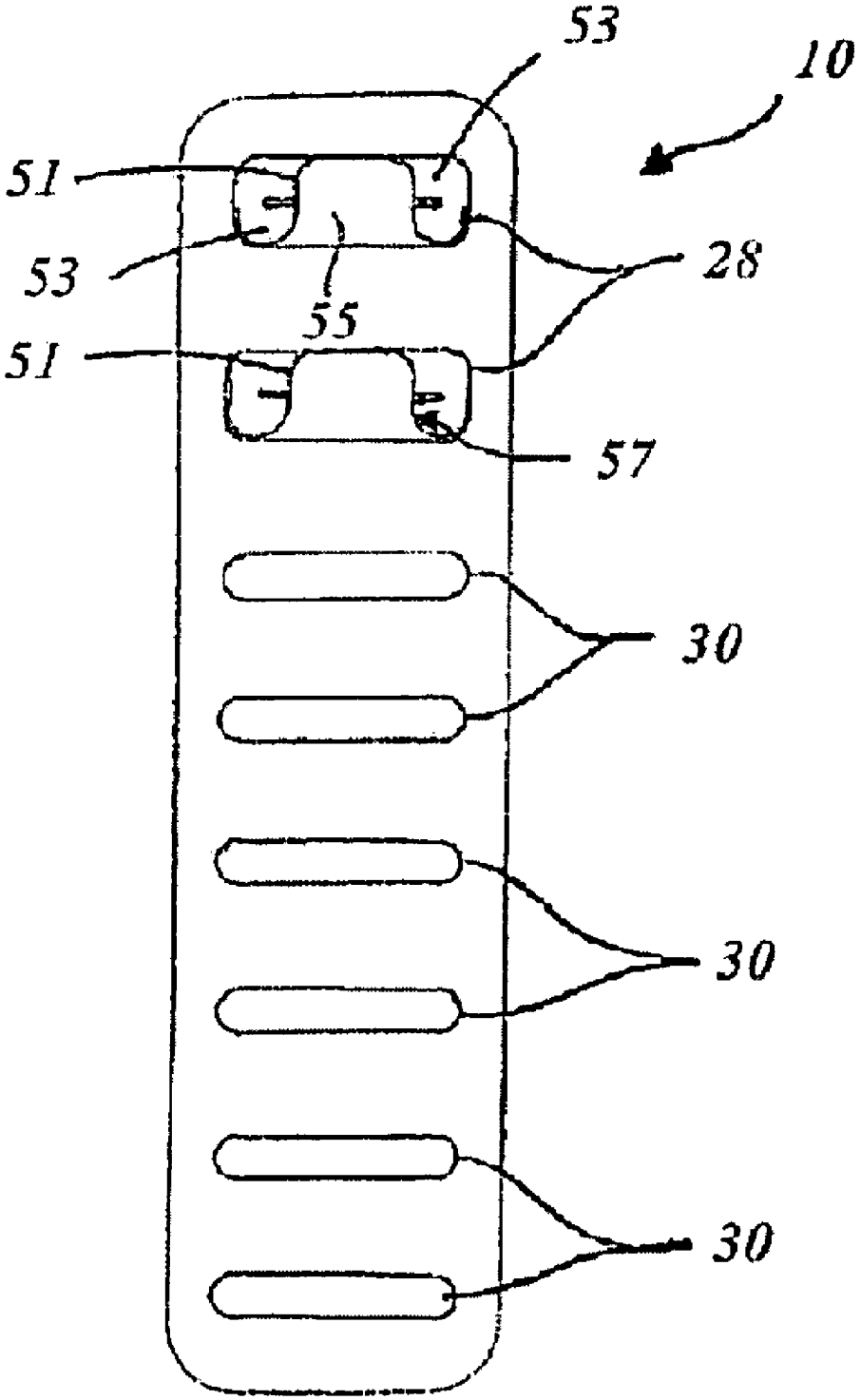
FIG. 9 is a cross-sectional view, taken along line 9-9 of the heat exchanger of FIG. 1.

The passageways of the tubes may be provided in a variety of shapes such as square, rectangular, circular, elliptical, irregular or the like. In preferred embodiments, as shown in FIG. 9, the passageways of tubes may include one or more partitions, fins or the like 51. As used herein, a partition 51 for a passageway in a tube is a structure (e.g., a wall) that substantially divides at least part of the passageway into a first 53 and second 55 portion. The partition 51 preferably is continuous (but may be non-continuous) such that the partition 51 completely separates the first portion 53 from the second portion 55 or the partition 51 may include openings (e.g., through-holes, gaps or the like) connecting the first 53 and second 55 portion.

As used herein, a fin 57 for a passageway in a tube 28 is intended to encompass nearly any structure (e.g. a protrusion, a coil, a member or the like), which is located within the passageway of the tube and is physically connected (e.g., directly or indirectly) to an outer surface of the tube that engages in heat exchange. The shape of each of the fins 57 may be the same or different relative to each other. Further, the pitch angle of each fin may be the same or different relative to each other. It will also be appreciated that the configuration of a tube may vary along its length. One or both tube ends may be provided with fins but the central portion left un-finned. Likewise, the central portion may be provided with fins but one or both of the tube ends are left un-finned. Fin spacing may be constant within a passageway or may be varied as desired.

It is contemplated that various numbers of partitions and fins may be used depending upon the size, shape, configuration or the like of the passageways, tubes or both. The fins may be any desirable shape, for instance they may have a sectional profile that is rectangular, rounded or the like. Preferably, the partitions can divide the passageways into various numbers of portions of various different sizes and shapes or of substantially equivalent sizes and shapes. As examples, the portions may be contoured, straight, rectangular or otherwise configured.

For certain applications, and particularly for lower viscosity fluids, it can be advantageous to have substantially equally sized passageways such that flow through each of the passageway is substantially equivalent and promotes higher amounts of heat transfer. In alternative embodiments, a tube may be divided into one or more of a plurality of first passageways having a first sectional area and one or a plurality of second passage ways having a second sectional area (e.g. larger, smaller of different shape relative to the first passageways). Additionally, the partitions of the tube may extend horizontally, vertically, diagonally, combinations thereof or otherwise.

Advantageously, tubes with passageways divided into larger and smaller sub-passageways, such as those above, have the ability to effectively perform a passive bypass function particularly for the cooling of relatively high viscosity fluids flowing through the tubes. In particular, a higher viscosity fluid will typically be more viscous at lower temperatures and, consequently, more of the fluid will flow through the larger sub-passageways and bypass the smaller sub-passageways resulting in less heat transfer from the fluid. In contrast, as the temperature of the fluid elevates, the fluid will become less viscous and, consequently, the rate will increase at which the fluid is able to flow through the smaller sub-passageways. Thus, the diverse passageway structure tube facilitates, flow of the high viscosity fluid through the tube at cooler temperatures.

In other alternative embodiments, surfaces defining the internal portions of any of the internal passageways of the tubes may be smooth or planar or may be contoured such as corrugated (e.g., including several patterned ridges), ribbed (i.e., including several protrusions), dimpled (e.g., including several depressions) or another suitable fin structure. Spiral or helical grooves or ridges may be provided. In still other alternative embodiment, the tubes may include one or more internal inserts, which are fabricated separately from the tubes but subsequently assembled together. It is contemplated that inserts may be formed in a variety of configurations and shapes for insertion into passageways or portions of passageways of tubes. For example, and without limitation, inserts may be members (e.g., straight or contoured members) with complex or simple configurations. Alternatively, inserts may be coils, springs or the like.

Formation of tubes according to the present invention may be accomplished using several different protocols and techniques. As examples, tubes may be drawn, rolled, cast or otherwise formed. Additionally, tubes according to the present invention may be formed of a variety of materials including plastics, metals, carbon, graphite, other formable materials or the like. Preferably, however, the tubes are a metal selected from copper, copper alloys, low carbon steel, stainless steel, aluminum alloys, titanium alloys or the like. The tubes may be coated or otherwise surface treated over some or all of its length for locally varying the desired property.

In the tubes of the heat exchangers of the present invention, a hydraulic diameter in the range of desired hydraulic diameters is preferred to obtain maximum effectiveness of the exchanger.

As used herein, hydraulic diameter ($D_H$) is determined according to the following equation:

$$D_h=4A_P/P_w$$

wherein $A_p$=wetted cross-sectional are of the passageway of a tube; and $P_w$=wetted perimeter of the tube.

Each of the variables ($P_w$ and $A_p$) for hydraulic diameter ($H_d$) are determinable for a tube according to standard geometric and engineering principles and will depend upon the configuration of a particular tube and the aforementioned variables for that tube (i.e., the number of partitions, the number of portions, the size of the portions, the size of the passageways or a combination thereof).

Heat transfer and pressure drop for a fluid flowing through the tubes can be determined for a range of hydraulic diameters using sensors such as pressure gauges, temperature sensors or the like.

Thus, the number of partitions, number of sub-passageways, the size of the sub-passageway, fin size shape or location or the like may be varied and thereafter measured for providing the desired hydraulic diameter or a hydraulic diameter in the desired hydraulic diameter range for a predetermined length of tube. Various exemplary hydraulic diameter ranges are preferably determined for viscous fluids such as engine oil, transmission oil and power steering oil at vehicle specific parameters., Radiator tube hydraulic diameters are designed to meet individual vehicle requirements.

For a multi-fluid heat exchanger, it may be desirable for the tubes designed to transport one of the fluids to be sized, dimensioned or both relative to the tubes that are designed to transport the other fluid[s]. In particular, for a multi-fluid heat exchanger designed to handle a first fluid such as a radiator coolant and a second fluid such as an oil (e.g., transmission or power steering oil), and a third fluid such as a refrigerant, it is desirable for the internal and external surface areas of the various tubes to be sized, dimensioned or both relative to each other to provide for greater amounts of heat transfer to and/or from the fluids.

According to a preferred aspect of the present invention, a multi-fluid heat exchanger includes tubes for transporting a first fluid such as a radiator coolant and tubes for transporting a second fluid such as an oil (e.g., transmission oil, power steering oil or the like) and tubes for transporting a third fluid such as condenser fluid (e.g. refrigerant, CO2, etc.). For the tubes transporting the radiator fluid, a large amount of thermal resistance to heat exchange is produced at the external surface of the tube relative to any amount of thermal resistance produced at the internal surface of the tube. However, for the tubes transporting the oil, a large amount of thermal resistance is produced at the internal surface of the tube relative to the any amount of thermal resistance produced at the external surface of the tube. As a result, it is generally desirable for the tube transporting the radiator fluid to have a larger external surface area relative to its internal surface area while it is generally desirable for the tube transporting the oil to have a larger internal surface area relative to its external surface area.

In certain embodiments of the invention, it is preferable for the heat exchanger to include one or more end plates for providing protection to the tubes of the heat exchanger. The end plates may be provided in various different configurations and may be substantially planar or contoured, continuous or non-continuous or otherwise configured. Additionally, the end plates may be provided as separate units that may be connected or attached to one or more of the components (e.g., the end tanks) of the heat exchanger. Alternatively, the end plates may be provided as integral with one or more of the components (e.g., the end tanks) of the heat exchanger.

According to one highly preferred embodiment, one or both of the end plates are omitted. The function of end plates is the end plates is provided by end tubes instead. For example, the end tubes are substantially identical to one or more of the fluid carrying tubes of the heat exchanger.

The invention has been illustrated herein generally by reference to a three fluid heat exchanger. However, it is not intended to be limited thereby. It is also contemplated that the inventive features are adapted for providing even a heat exchanger for fluids in addition to three fluids. As with the two fluid exchanger preferred herein, any other multi-fluid heat exchanger preferably includes a common set of end tanks and a plurality of tubes arrayed generally parallel to each other and bridging the end tanks.

Figure 2:
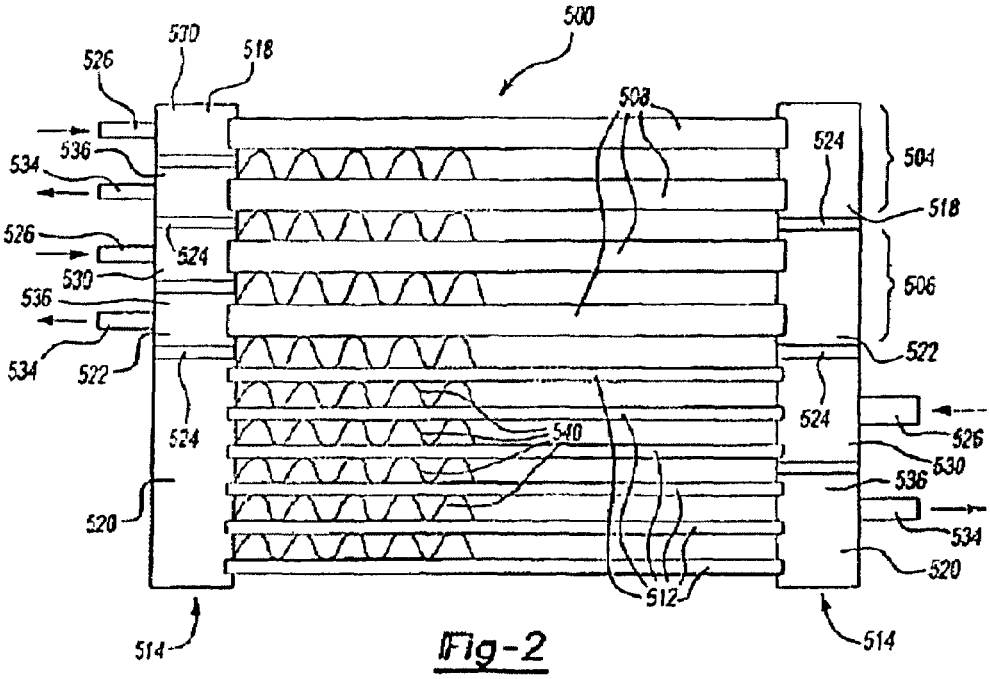
FIG. 2 is an elevational view of another exemplary heat exchanger in accordance with an aspect of the present invention.

Referring to FIG. 2, there are illustrated triple fluid heat exchangers 500 formed according to preferred embodiments of the present invention. Each of the heat exchangers 500 include a first plurality 504 and second plurality 506 of larger tubes 508 and a plurality of smaller tubes 512. It should be understood that the pluralities of tubes may be arranged in a variety of configuration including side by side arrangements, stacked arrangements, combinations thereof and the like. In all arrangements, attachment means are used as necessary for the assembly configurations. In FIG. 2, the heat exchanger 500 include a pair of end tanks 514 each with a first or upper portion 518, a second or lower portion 520 and a third or middle portion 522 separated from each other by baffles 524. Both the upper and middle portions 518, 522 of one of the tanks 514 include an oil inlet 526 in fluid communication with an inlet portion 530 of the upper and middle portions 518, 522 and an oil outlet 534 in fluid communication with an outlet portion 536 of the upper and middle portions 518, 522. The lower portion 520 of one of the tanks 514 includes an inlet 526 in fluid communication with an inlet portion 530 of the lower portion 520 and an outlet 534 in fluid communication with an outlet portion 536 of the lower portion 520. As shown, the inlet portions 530 and outlet portions 536 are separated from each other by baffles 524. Also, as shown, fins 540 separate the tubes 508, 512 substantially as described previously and the pluralities 504, 506 of tubes 508 are stacked atop one another. Though shown as having similar tubes for two of the heat exchangers there may be a different tube structure used for each fluid heat exchanger in the assembly, or all three could be similar.

In operation, oils and preferably two separate oils such as power steering or transmission oil flow through the inlets 526 to the inlet portions 530 of the upper and middle portions 518, 522 of their respective end tank 514. The oils then flow through at least one of the pluralities 504, 506 of tubes 508 to the upper and middle portions 518, 522 of the opposite end tank 514. Thereafter, the oils flow through at least another of the pluralities 504, 506 of tubes 508 to the outlet portions 536 of the upper and middle portions 518, 522 of the respective end tank 514 and out through the respective outlets 534. Additionally, a third fluid (e.g., a condenser fluid) flows through the inlet 526 to the inlet portion 530 of the lower portion 520 of its respective end tank 514. The third fluid then flows through at least one of the plurality of smaller tubes 512 to the lower portion 520 of the opposite end tank 514. Thereafter, the third fluid flows through at least another of the plurality of smaller tubes 512 to the outlet portion 536 of the lower portion 520 of the respective end tank 514 and out through the outlet 534.

The present invention may be further optimized by the employment of an improved passive bypass system, the employment of an improved baffle or baffle system or a combination thereof. The present invention may also further be optimized by positioning inlet and outlet at various locations and by varying the size, type and shape of the inlet and/or outlet.

Figure 3:
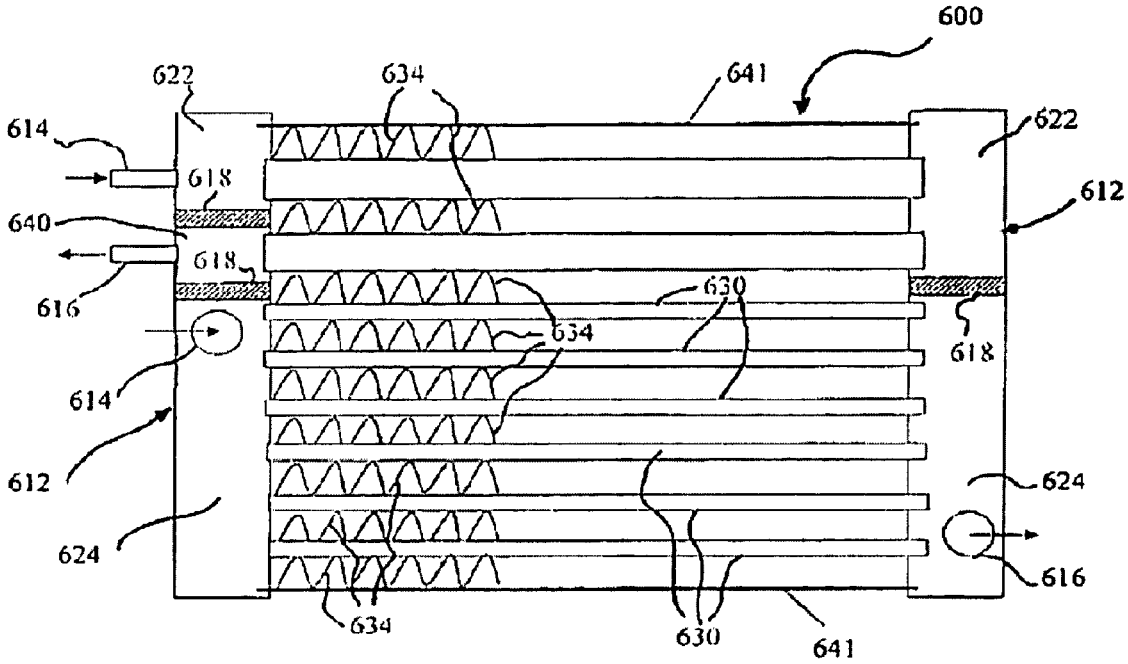
FIG. 3 is an elevational view of another exemplary heat exchanger in accordance with an aspect of the present invention, including a combo cooler with radiator fluid and oil.

More specifically, referring to FIG. 3, there is illustrated a heat exchanger 600 according to one preferred aspect of the present invention. The heat exchanger 600 includes a pair of end tanks 612. Each of the end tanks includes or supports an inlet 614, an outlet 616 and baffles 618. Of course, it is also possible to locate all inlets, outlets and baffles in only one of the end tanks. Additionally, each of the end tanks 612 includes a first tank portion 622 separated from a second portion 624 by at least one of the baffles 618. The heat exchanger 600 also includes a plurality of tubes 628, 630 extending between the end tanks 612. Preferably, the tubes 628, 630 are separated from each other by fins 634.

Depending upon the configuration of the heat exchanger, it may be possible to provide common end tanks that are divided to accommodate more than one fluid or separate end tanks for accommodating plural fluids. It is also possible that end plates 641 can be employed to bridge the end tanks in accordance with the present invention. However, it is particularly preferred that the heat exchanger employs end tubes in lieu of end plates. In this manner, weight savings and improved efficiency is possible owing to a reduced variety of component types.

In the preferred embodiment shown, the heat exchanger 600 includes a plurality of a first set of tubes 628 extending between and in fluid communication with a first portion 622 (e.g. an upper portion) of the end tanks 612 and a plurality of a second set of tubes 630 in fluid communication with the second portion 624 (e.g. a lower portion) of the end tanks 612. The tubes 628 and 630 could be of any combination of sizes which meet vehicle specific requirements.

During flow of the first and second fluids through the tubes 28, 30, an ambient fluid preferably flows over the outside of the tubes 28, 30, the fins 34 or both. In turn, heat may be transferred from the first and second fluids to the ambient fluid or from the ambient fluid to the first and second fluids. The first and second fluids may be of the same or a different viscosity. For example, in one preferred embodiment, the first fluid has a higher viscosity than the second fluid. For example, and without limitation, the first fluid may be transmission oil, coolant oil, engine oil, power steering oil or the like while the second fluid will typically be a radiator coolant.

From the above, it will thus be appreciated that one preferred method of the present invention contemplates providing a multi-fluid heat exchanger assembled in a common assembly; passing a first fluid through one portion of the heat exchanger for heat exchange, and passing at least one additional fluid through at least one additional portion of the heat exchanger for heat exchange of the additional fluid.

It is contemplated that a heat exchanger formed in accordance with the present invention may include one or more tubes having various different internal configurations for defining passageways within the tubes. They may also have different external configurations defining one or more outer peripheral surfaces of the tubes. Further it is possible that the internal configurations, external configuration or both vary along the length of the tube.

The internal configuration of a tube may be the same or different from the external configuration. For instance, the walls of the tubes may have opposing sides that are generally parallel to or otherwise complement each other. Alternatively, they may have a different structure relative to each other. The external configuration of the tube may include grooves, ridges, bosses, or other structure along some or all of its length for assisting in heat transfer. Likewise, the internal configuration may include grooves, ridges, bosses or other structure.

It is also possible that the structure is provided for generating turbulence within the fluid, or for otherwise controlling the nature of the flow of fluid there-through or for strength.

The passageways of the tubes may be provided in a variety of shapes such as square, rectangular, circular, elliptical, irregular or the like. In preferred embodiments, the passageways of tubes may include one or more partitions, fins or the like. As used herein, a partition for a passageway in a tube is a structure (e.g., a wall) that substantially divides at least part of the passageway into a first and second portion. The partition may be non-continuous or continous, but is preferably continuous such that the partition completely separates the first portion from the second portion. The partition may also preferentially include openings (e.g., through-holes, gaps or the like) connecting the first and second portion.

As used herein, a fin for a passageway in a tube is intended to encompass nearly any structure (e.g. a protrusion, a coil, a member or the like), which is located within the passageway of the tube and is physically connected (e.g., directly or indirectly) to an outer surface of the tube that engages in heat exchange. The shape of each of the fins may be the same or different relative to each other. Further, the pitch angle of each fin may be the same or different relative to each other. It will also be appreciated that the configuration of a tube may vary along its length. One or both tube ends may be provided with fins but the central portion left un-finned. Likewise, the central portion may be provided with fins but one or both of the tube ends are left un-finned. Fin spacing may be constant within a passageway or may be varied as desired.

It is contemplated that various numbers of partitions and fins may be used depending upon the size, shape, configuration or the like of the passageways, tubes or both. The fins may be any desirable shape, for instance they may have a sectional profile that is triangular, rectangular, rounded or the like. Preferably, the partitions can divide the passageways into various numbers of portions of various different sizes and shapes or of substantially equivalent sizes and shapes. As examples, the portions may be contoured, straight, rectangular or otherwise configured.

Figure 4:
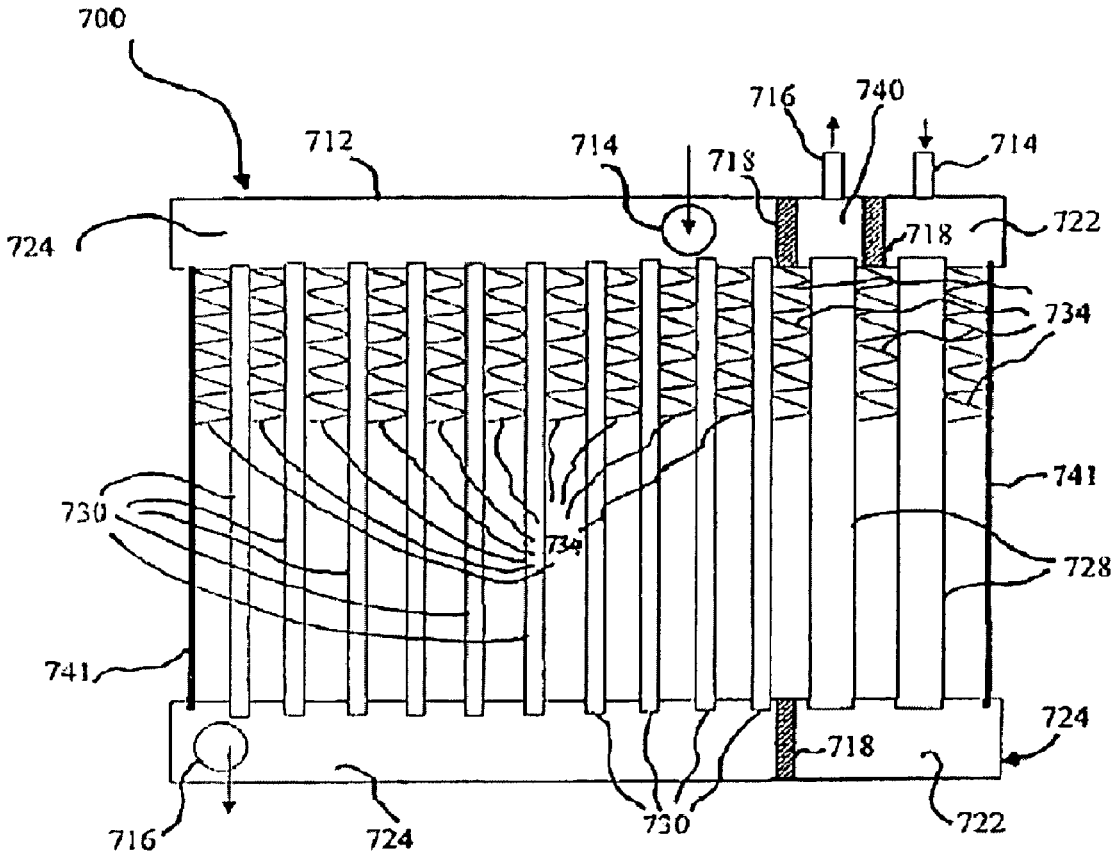
FIG. 4 is an elevational view of another exemplary heat exchanger in accordance with an aspect of the present invention, including a down flow or vertical flow arrangement.

Referring to FIG. 4, there is illustrated a heat exchanger 700 according to one preferred aspect of the present invention. The heat exchanger 700 includes a pair of end tanks 712. Each of the end tanks includes or supports an inlet 714, an outlet 716 and baffles 718. Of course, it is also possible to locate all inlets, outlets and baffles in only one of the end tanks. Additionally, each of the end tanks 712 includes a first tank portion 722 separated from a second portion 724 by at least one of the baffles 718. The heat exchanger 700 also includes a plurality of tubes 728, 730 extending between the end tanks 712. Preferably, the tubes 728, 730 are separated from each other by fins 734.

Depending upon the configuration of the heat exchanger, it may be possible to provide common end tanks that are divided to accommodate more than one fluid or separate end tanks for accommodating plural fluids. It is also possible that end plates 741 can be employed to bridge the end tanks in accordance with the present invention. However, it is particularly preferred that the heat exchanger employs end tubes in lieu of end plates. In this manner, weight savings and improved efficiency is possible owing to a reduced variety of component types.

In the preferred embodiment shown, the heat exchanger 700 includes a plurality of a first set of tubes 728 extending between and in fluid communication with a first portion 722 (e.g. an upper portion) of the end tanks 712 and a plurality of a second set of tubes 730 in fluid communication with the second portion 724 (e.g. a lower portion) of the end tanks 712. The tubes 728 and 730 could be of any combination of sizes which meet vehicle specific requirements. In the preferred embodiment shown, the fluid flow in heat exchanger 700 is vertical.

Figure 5:
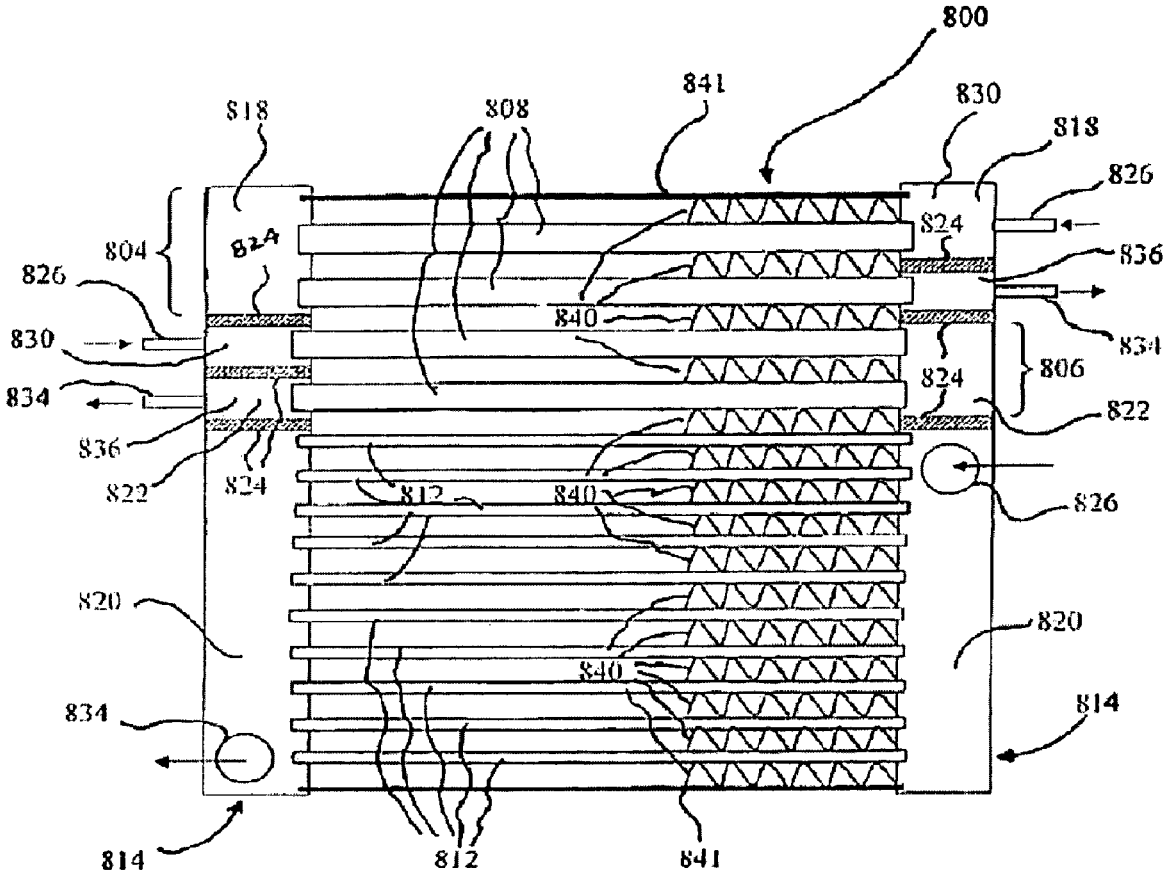
FIG. 5 is an elevational view of another exemplary heat exchanger in accordance with an aspect of the present invention, in a tri-cooler arrangement.

Referring to FIG. 5, there are illustrated triple fluid heat exchangers 800 formed according to preferred embodiments of the present invention. Each of the heat exchangers 800 include a first plurality 804 and second plurality 806 of larger tubes 808 and a plurality of smaller tubes 812. It should be understood that the pluralities of tubes may be arranged in a variety of configuration including side by side arrangements, stacked arrangements, combinations thereof and the like. In all arrangements, attachment means are used as necessary for the assembly configurations.

In FIG. 5, the heat exchanger 800 include a pair of end tanks 814 each with a first or upper portion 818, a second or lower portion 820 and a third or middle portion 822 separated from each other by baffles 824. Both the upper and middle portions 818, 822 of each of the tanks 814 include an oil inlet 826 in fluid communication with an inlet portion 830 of the upper and middle portions 818, 822 and an oil outlet 834 in fluid communication with an outlet portion 836 of the upper and middle portions 818, 822. The lower portion 820 of one of the tanks 814 includes an inlet 826 in fluid communication with the lower portion 820 and an outlet 834 in fluid communication with a lower portion 820 of a second tank. As shown, the inlet portions 830 and outlet portions 836 are separated from each other by baffles 824. Also, as shown, fins 840 separate the tubes 808, 812 substantially as described previously and the pluralities 804, 806 of tubes 808 are stacked atop one another. Though shown as having similar tubes for two of the heat exchangers there may be a different tube structure used for each fluid heat exchanger in the assembly or all three could be similar.

In operation, oils and preferably two separate oils such as power steering or transmission oil flow through the inlets 826 to the inlet portions 830 of the upper and middle portions 818, 822 of their respective end tank 814. The oils then flow through at least one of the pluralities 804, 806 of tubes 808 to the upper and middle portions 818, 822 of the opposite end tank 814. Thereafter, the oils flow through at least another of the pluralities 804, 806 of tubes 808 to the outlet portions 836 of the upper and middle portions 818, 822 of the respective end tank 814 and out through the respective outlets 834. Additionally, a third fluid (e.g., a radiator coolant fluid) flows through the inlet 826 to the inlet lower portion 820 of its respective end tank 814. The third fluid then flows through at least one of the plurality of smaller tubes 812 to the lower portion 820 of the opposite end tank 814. Thereafter, the third fluid flows through the outlet 834.

The present invention may be further optimized by the employment of an improved passive bypass system, the employment of an improved baffle or baffle system or a combination thereof. The present invention may also further be optimized by positioning inlet and outlet at various locations and by varying the size, type and shape of the inlet and/or outlet.

Preferably, an exchanger in accordance with the present invention includes at least one bypass element for defining a passageway between a first stream of a fluid and a second stream of the fluid, for abbreviating the overall path that is ordinarily expected to be traveled by the fluid. For example, a first entry stream may have an ordinary flow path that would take an entering fluid through the entire tube assembly intended for such fluid. The second stream may be the exit stream of the fluid upon total or partial completion of the passage through the heat exchanger. A bypass for that fluid would result in the fluid flow path being intercepted at an intermediate location and being diverted so that the fluid need not pass entirely through the heat exchanger. Instead, it may immediately become part of the exit stream.

It will be appreciated that the incorporation of a bypass element in a multi-fluid heat exchanger is particularly attractive when the fluids to pass through the respective different portions of the heat exchanger have different flow characteristics (either from an intrinsic fluid property, as the result of an operating condition to which the fluid has been exposed or both In certain preferred aspects of the present invention, at least one bypass element is employed to correspond to each different fluid to pass through the heat exchanger. Thus, for example, if three different fluids are to pass through their own respective portions of the heat exchanger, then there would be at least three bypass elements. Fewer bypass elements may be employed as well.

The bypass element may be positioned at various locations adjacent (e.g., on or near an external surface) or within the heat exchanger. The bypass is preferably located substantially, partially or entirely outside of the components of the heat exchanger.

It is contemplated that the bypass element may be partially or fully defined by (e.g., be integral with) the components (i.e., the end tanks, the tubes, the baffles, the fins, the inlets, the outlets or combinations thereof) of the heat exchanger. Alternatively, however, the bypass may be partially or fully defined by assemblies or members that may or may not be attached to or integrated within the components of the heat exchanger. Members or assemblies for defining the bypass may be formed of a variety of materials depending upon their location. Preferably, the members or assemblies are formed of materials compatible with (e.g. the same as) materials that form the components of the heat exchanger. One particularly preferred material is a metal such as aluminum.

Figure 6:
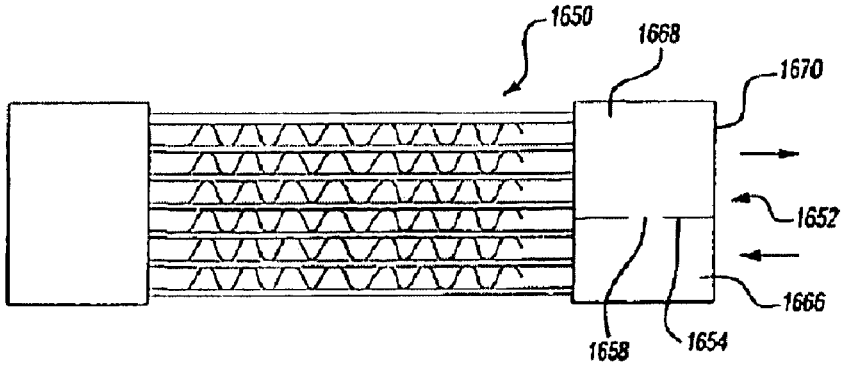
FIG. 6 is an elevational view of another exemplary heat exchanger in accordance with an aspect of the present invention.

In still other embodiments of the invention, it is contemplated that a heat exchanger may include one or more bypass tubes that perform the passive bypass function for the heat exchanger that was described earlier. In such embodiments, the bypass tube is typically configured such that fluid flowing through the bypass tube engages in less heat exchange than fluid flowing through other tubes of the heat exchanger (referred to herein as heat exchange tubes). As such, a hydraulic diameter of the bypass tube is typically larger than a hydraulic diameter of the heat exchange tube. Thus, a lower pressure differential is typically required to induce flow through a bypass tube as opposed to the heat exchange tube. According to another embodiment, a bypass may be formed in a baffle of a heat exchanger. Referring to FIG. 6, there is illustrated a heat exchanger 1650 having a bypass orifice 1652 formed in a baffle 1654. As can be seen, the baffle 1654 provides a passageway 1658 of the bypass orifice 1652 wherein the passageway 1658 is in fluid communication with an inlet portion 1666 and an outlet portion 1668 of an end tank 1670 of the heat exchanger 1650.

The present invention is not intended to be limited only to the provision of a passive bypass, but may also include the use of a passive bypass in combination with an active bypass element (e.g., including a valve), an electronically controlled bypass element or both. The latter active or electronically controlled bypass elements may also be used alone.

It should be appreciated that the bypass features disclosed herein have been illustrated with particular reference to their use in a multi-fluid heat exchanger. However, they also find application in single fluid heat exchangers. Accordingly, the present invention also contemplates a single fluid heat exchanger and its operation, including a bypass feature.

In one particular aspect of the present invention, it is preferable that any baffle employed be generally disk-shaped (or otherwise conforms generally with an interior of the section in which it is introduced) with a first substantially planar outwardly facing surface opposite (either in spaced or in contacting relation with) a second substantially planar outwardly facing surface. Preferably, and as shown in FIG. 1, the baffle 18 includes a central portion 19 and a flanged peripheral portion 21. The peripheral portion 21 of the baffle is preferably thicker than the central portion 19, exhibiting a dog bone shaped or X-shaped profile for providing a peripheral channel. Also preferred is the baffle disposed within the end tank so that the peripheral channel is substantially juxtaposed with the through-hole in the end tank for providing a visual leak indicator and also substantially juxtaposed with at least one of the fins in the space between the tubes. More preferred is a baffle system including a baffle or baffles with a central portion and (at least one) flanged peripheral portion, the flanged peripheral portion having a peripheral channel. Even more preferably, the baffle system comprises double baffles, i.e. a first and a second baffle being assembled back to back with a common center contact portion.

Unless stated otherwise, dimensions and geometries of the various structures depicted herein are not intended to be restrictive of the invention, and other dimensions or geometries are possible.

Figure 7A:
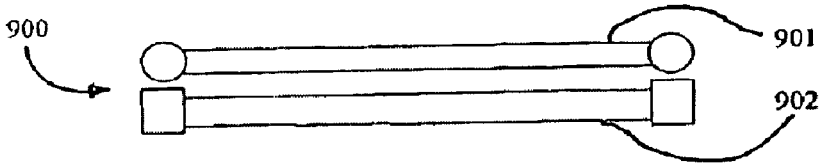
FIGS. 7(A)-7(B) are side schematic sectional views of exemplary dual multi cooler arrangement heat exchangers in accordance with an aspect of the present invention, both in parallel and side by side.

Referring to FIG. 7A, illustrated are heat exchangers 900 in parallel arrangement. The heat exchanger 901 is a multi fluid heat exchanger with one of the fluid being a refrigerant and the other fluids being automotive fluids. The heat exchanger 902 is a multi fluid heat exchanger with one of the fluid being radiator coolant and the other fluids being automotive fluids. Also it can be conceived to have other combinations such as radiator coolant and refrigerant as a part of a multi fluid heat exchanger and the like.

Figure 7B:
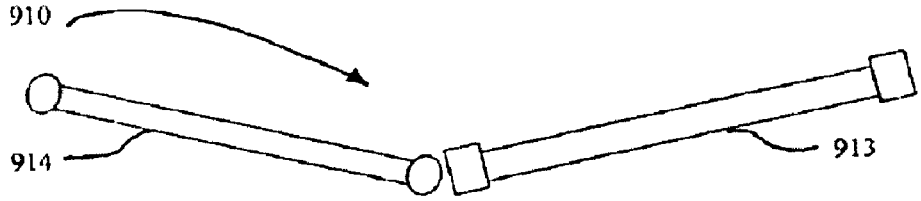

Similarly in FIG. 7B, are illustrated heat exchangers 910 in side by side arrangement. The heat exchanger 914 is a multi fluid heat exchanger with one of the fluid being refrigerant and the other fluids being automotive fluids. The heat exchanger 913 is a multi fluid heat exchanger with one of the fluid being radiator coolant and the other fluids being automotive fluids. Also it can be conceived to have other combinations such as radiator coolant and refrigerant as a part of a multi fluid heat exchanger and the like.

Figure 8:
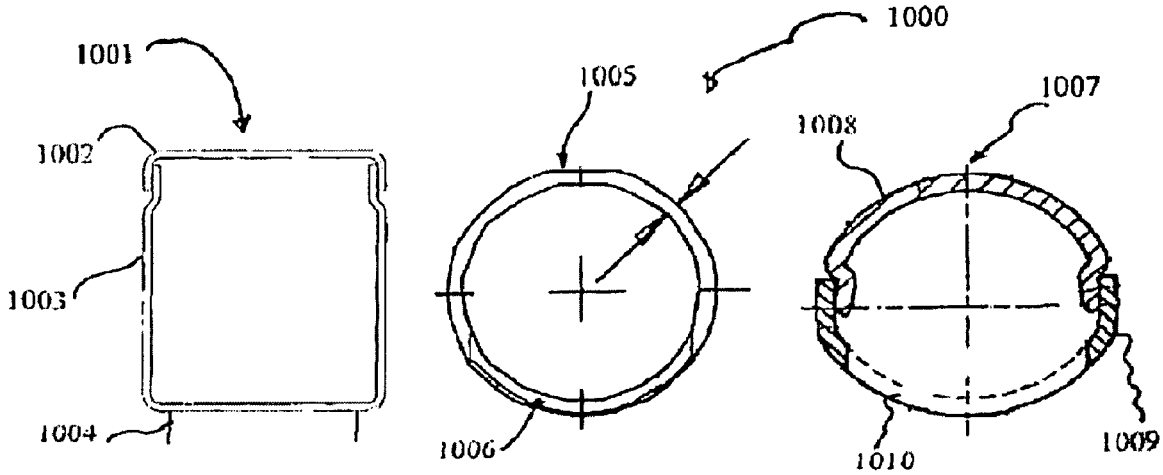
FIG. 8 is a cross-sectional view of metal end tanks of a heat exchanger in accordance with an aspect of the present invention.

In FIG. 8, typical cross sections 1000 of the end tanks are shown Although the cross sections can be of many shapes and forms 1003 is illustrated as rectangular and is made up of more than one part, 1005 is a circular cross section made up of one part, and 1007 is made up of more than one part. The cross section 1001 has part 1002 and part 1003 forming the cross section 1001. The tubes 1004 is also shown as reference.

Similarly cross section 1007 is made up of part 1008 and 1009. The opening for the tube 1010 is also shown.

The cross section 1005 is made up of one part and also shows opening 1006 for tube.

Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger, comprising:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough;

a plurality of fins disposed between the first and second tubes, with the first and second tubes and the fins being generally coplanar relative to each other;

an inlet and an outlet on the first end tank for the first fluid flow;

an inlet on the first end tank and an outlet on the second end tank for the second fluid flow; and means for performing a passive bypass function including at least one of: a passageway formed within each of the plurality of first tubes and having partitions which divide the passageway; or at least one of the first tubes, second tubes or a plurality of third tubes having a hydraulic diameter other than that of the other tubes;

wherein at least one of the first fluid or second fluid is a radiator fluid.

2. The heat exchanger as in claim 1 wherein the first end tank and the second end tank each include at least one baffle having a peripheral portion and central portion, and wherein the peripheral portion is thicker than the central portion.

3. The heat exchanger as in claim 1 wherein the partitions include fins.

4. The heat exchanger as in claim 1 wherein the first fluid is an oil.

5. The heat exchanger as in claim 1, wherein the fluid flow direction is vertical or down flow from top to bottom or bottom to top.

6. A heat exchanger, comprising:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough;

a plurality of third tubes, smaller in hydraulic diameter than the first and second tubes, and in fluid communication with the first and second end tanks, the plurality of third tubes adapted to have a third fluid, different from the first or second fluid, flow therethrough;

a plurality of fins disposed between the first, second and third tubes, with the majority of fins being generally co-planar relative to each other;

an inlet and an outlet on the first end tank for the first fluid flow;

an inlet on the first end tank and an outlet on the second end tank for the second fluid flow; and means for performing a passive bypass function including at least one of: a passageway formed within each of the plurality of first tubes, second tubes or third tubes, the passageway having partitions which divide it; or the hydraulic diameter of at least one of the first tubes, second tubes or third tubes being other than that of the other tubes;

wherein the third fluid is a radiator fluid.

7. The heat exchanger as in claim 6 wherein the first end tank and the second end tank each include at least one baffle.

8. The heat exchanger as in claim 6 wherein the partitions include fins.

9. The heat exchanger as in claim 6 wherein the first fluid is an oil.

10. The heat exchanger as in claim 6, wherein the first or second fluid is an oil.

11. The heat exchanger as in claim 6, wherein the fluid flow direction is vertical or down flow from top to bottom or bottom to top.

12. A heat exchanger, comprising:

a first end tank;

a second end tank opposite the first end tank;

a plurality of first metal tubes in fluid communication with the first and second end tanks, and being adapted to have a first fluid flow therethrough;

a plurality of second metal tubes in fluid communication with the first and second end tanks, and being adapted to have a second fluid, different from the first fluid, flow therethrough;

a plurality of third metal tubes, smaller in hydraulic diameter than the first and second metal tubes, in fluid communication with the first and second end tanks, and being adapted to have a third fluid, different from the first fluid or second fluid, flow therethrough, and a plurality of fins disposed between any of the first, second or third tubes, with at least two of the first, second or third tubes and the fins being generally coplanar relative to each other; and means for performing a passive bypass function including at least one of: a passageway having partitions which divide the passageway formed within each of the plurality of first tubes, second tubes, or third tubes or an inlet and an outlet on the first end tank for the first fluid flow and an inlet on the first end tank and an outlet on the second end tank for the second fluid flow, wherein at least one of the first tubes, second tubes or third tubes is of another hydraulic diameter than one of the other tubes, and wherein the third tubes are smaller in hydraulic diameter than the at least one first and second tubes;

wherein at least one of the first, second or third metal tubes includes an interior wall structure including a partition adapted for subdividing the tube into a plurality of passageways within the tube.

13. The heat exchanger as in claim 12 wherein the first end tank and the second end tank each include at least one baffle.

14. The heat exchanger as in claim 12, having an inlet and an outlet on the first end tank for the first fluid flow and an inlet on the first end tank and an outlet on the second end tank for the second fluid flow.

15. The heat exchanger as in claim 12 wherein the partition includes at least one fin.

16. A heat exchanger for an automotive vehicle, comprising:

at least one end tank;

at least two heat exchangers including a plurality of spaced apart metal tubes with fins between the spaced tubes;

means for allowing a passive bypass function including at least one of a passageway having partitions which divide the passageway formed within each of the plurality of spaced apart metal tubes or at least one of the spaced apart metal tubes is of another hydraulic diameter than one of the other spaced apart metal tubes;

at least three baffles in the at least one end tank;

the heat exchangers being disposed so that their respective tubes and fins are generally coplanar with each other and are connected to the end tank;

at least two inlets or at least two outlets on the at least one end tank; and the heat exchangers are selected from the group consisting of an oil heat exchanger, a condenser, a radiator, or combinations thereof.

17. The heat exchanger as in claim 16 wherein the at least one of said heat exchangers is a radiator.

18. A heat exchanger system, comprising:

one heat exchanger and at least one other heat exchanger, each of which includes:

a first end tank;

a second end tank opposite the first end tank;

plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough;

a plurality of fins disposed between the first and second tubes, with the first and second tubes and the fins being generally coplanar relative to each other;

an inlet and an outlet on the first end tank for the first fluid flow;

an inlet on the first end tank and an outlet on the second end tank for the second fluid flow; and means for allowing a passive bypass function including at least one of a passageway having partitions which divide the passageway formed within each of the plurality of first tubes or at least one of the first tubes, second tubes or a plurality of third tubes is of another hydraulic diameter than one of the other tubes, wherein at least one of the first fluid or second fluid is a radiator fluid.

19. The heat exchanger system as in claim 18, wherein one heat exchanger is adapted to have a fluid selected from the group of radiator coolant and an automotive fluid, and the at least one other heat exchanger is adapted to have a fluid selected from the group of automotive fluids.

20. The heat exchanger system as in claim 18, wherein the heat exchangers are arranged in parallel.

21. The heat exchanger system as in claim 18, wherein the heat exchangers are arranged side by side.

22. A heat exchanger system, comprising:

one heat exchanger and at least one other heat exchanger, each of which includes:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid, different from the first fluid, flow therethrough;

a plurality of third tubes, smaller in hydraulic diameter than the first and second tubes, and in fluid communication with the first and second end tanks, the plurality of third tubes adapted to have a third fluid, different from the first or second fluid, flow therethrough;

a plurality of fins disposed between the first, second and third tubes, with the majority of fins being generally co-planar relative to each other;

an inlet and an outlet on the first end tank for the first fluid flow;

an inlet on the first end tank and an outlet on the second end tank for the second fluid flow; and means for performing a passive bypass function including at least one of a passageway having partitions which divide the passageway formed within each of the plurality of first tubes, second tubes, or third tubes or at least one of the plurality of first tubes, second tubes or third tubes is of another hydraulic diameter than one of the other tubes;

wherein the third fluid is a radiator fluid.

23. The heat exchanger system as in claim 22, wherein one heat exchanger is adapted to have a fluid selected from the group of radiator coolant and an automotive fluid, and the at least one other heat exchanger is adapted to have a fluid selected from the group of automotive fluids.

24. The heat exchanger system as in claim 22, wherein the heat exchangers are arranged in parallel.

25. The heat exchanger system as in claim 22, wherein the heat exchangers are arranged side by side.

* * * * *